US005295682A

United States Patent [19]

Leonard

[11] Patent Number: 5,295,682

[45] Date of Patent: Mar. 22, 1994

[54] PORTABLE BRIDGE FOR BILLIARDS

[76] Inventor: Robert G. Leonard, 1139A Shirley Blvd., Port Tobacco, Md. 20677

[21] Appl. No.: 19,597

[22] Filed: Feb. 19, 1993

[51] Int. Cl.[5] ..... A63D 15/10

[52] U.S. Cl. ..... 473/42

[58] Field of Search ..... 273/23

[56] References Cited

U.S. PATENT DOCUMENTS

| | | | |
|---|---|---|---|
| 690,617 | 1/1902 | Ruhland | 273/23 |
| 2,817,525 | 12/1957 | Niemann | 273/23 |
| 3,724,849 | 4/1973 | Pierce | 273/2 |
| 3,836,145 | 9/1974 | Frejd | 273/23 |
| 4,147,346 | 4/1979 | Giannetti | 273/23 |
| 4,215,859 | 8/1980 | Charlton | 273/23 |
| 4,538,809 | 9/1985 | Boomer | 273/18 |

FOREIGN PATENT DOCUMENTS

| | | | |
|---|---|---|---|
| 8657 | 9/1909 | United Kingdom | 273/23 |
| 107482 | 7/1917 | United Kingdom . | |
| 115606 | 5/1918 | United Kingdom . | |
| 2146908A | 5/1985 | United Kingdom . | |
| 2167311A | 5/1986 | United Kingdom . | |

OTHER PUBLICATIONS

"Maryland Independent", newspaper, Apr. 2, 1993.

*Primary Examiner*—Theatrice Brown

*Attorney, Agent, or Firm*—Leonard Bloom

[57] ABSTRACT

A portable bridge for use with a cue stick in a game of billiards. The bridge has a base with support means. An upright arm is connected to the base. The upright arm has at least one opening therein through which the cue stick is slidably received. In one embodiment, the front of the base has a concave end formed therein. When the cue stick is lifted, the concave top of the base engages a portion of a cue stick, the back of the base drops away from the cue stick and the portable bridge may be lifted and moved as desired. In an alternate embodiment, a keeper is provided to be manually adjusted on the cue stick, which prevents the cue stick from being withdrawn through the opening in the upright arm. The portable bridge may be lifted and moved to a desired location. The keeper may be manually adjusted to permit withdrawal of the cue stick from the opening in the upright arm.

12 Claims, 6 Drawing Sheets

15'
15
25
26
27
28
31
7

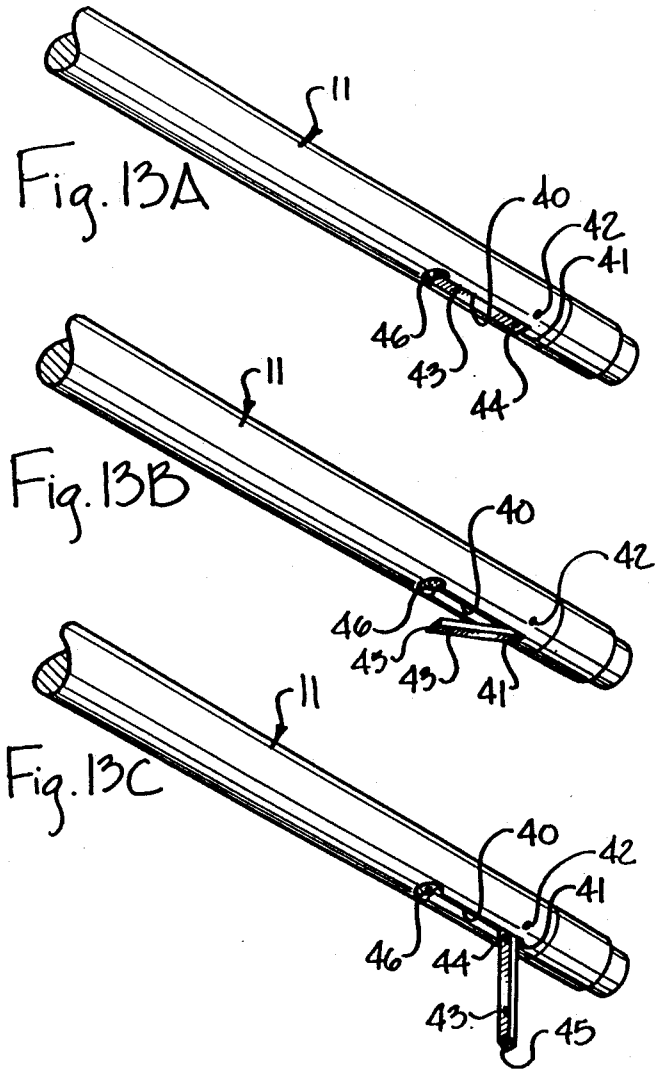
Fig. 13A
Fig. 13B
Fig. 13C
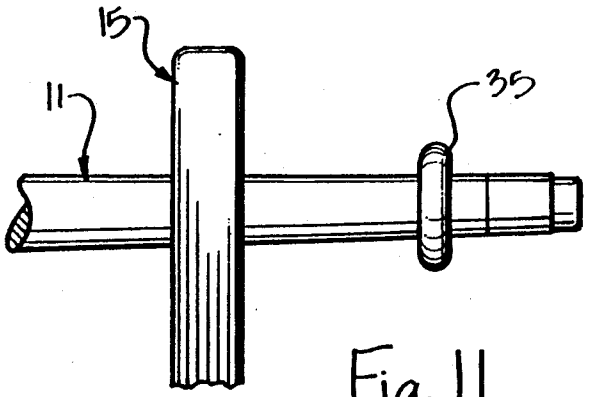
Fig. 11
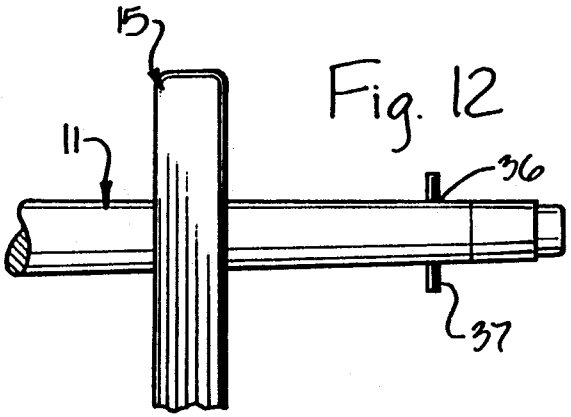
Fig. 12

PORTABLE BRIDGE FOR BILLIARDS

The present invention relates to a portable bridge to be used in the game of billiards, and more particularly to a bridge which is used in conjunction with a cue stick to move the bridge to a desired position on the table.

BACKGROUND OF THE INVENTION

In the game of billiards, pool and similar games, the players strike the billiard ball with the tip of a cue stick. The cue stick is supported near the tip to elevate the tip off the surface of the playing table so that the ball may be struck at a particular angle to direct the ball in a desired direction. Frequently, due to the disposition of the numerous balls on the surface of the table, or of the proximity of the ball to be struck to the edge of the table, it is very difficult to maneuver the cue stick to a manageable position. In these situations a bridge is commonly used. Traditionally, the bridge is connected to a pole so that the player must simultaneously manipulate the bridge pole and the cue stick. This situation is very difficult for most players, including the professional player. It is almost impossible for a handicapped or inexperienced player to effectively use the traditional bridge with a pole.

The applicant is aware of bridges and other devices for playing billiards which do not have a pole attached to the bridge as disclosed in the following:

| Inventor(s) | U.S. Pat. No. |
|---|---|
| Great Britain | 8,657 |
| Great Britain | 107,482 |
| Great Britain | 115,606 |
| Great Britain | 2,146,908A |
| Pierce | 3,724,849 |
| Frejd | 3,836,145 |
| Boomer | 4,538,809. |

All of these devices require the player to manually pick up and move the device to a desired location, frequently on an opposite side of the playing table which is distant from the player and requiring the player to walk to the opposite side of the playing table.

A bridge device is needed which does not have the pole attachment but still permits moving the bridge without the player walking around the playing table. Also, a simple bridge usable by handicapped and inexperienced players is needed.

SUMMARY OF THE INVENTION

Accordingly, it is a primary object of the present invention to provide a portable bride for use in the game of billiards which can be moved to a desired location by a player by use of the cue stick.

In accordance with the teachings of the present invention, there is disclosed a portable bridge for use with a cue stick in a game of billiards using billiard balls. The bridge is placed on and removed from, the surface of a playing table when desired. The bridge includes a base having a top, a bottom, a front and a back. The back has support means extending therefrom to provide stability to the base when the portable bridge is placed on the surface of the table. An upright arm is provided. Means are provided for connecting the upright arm substantially perpendicularly to the top of the base. The connecting means are disposed near the front of the base. The front of the base has an end and said end has a top and a bottom. The bottom of the end is adapted to rest on the surface of the playing table. The top of the end is concave. The upright arm has a plurality of spaced-apart openings formed therein, such that when the upright arm is connected to the base, said openings are aligned and oriented substantially vertically with respect to the base. Each opening has a cross section whereby the cue stick may be inserted in, and slidably received in, a selected opening in the upright arm to permit striking of a selected billiard ball with the cue stick. One of the openings in the upright arm is adjacent to the base, whereby, when the cue stick is inserted in said opening and the cue stick is lifted upwardly, the back of the base drops away from the cue stick and the concave top of the front of the base engages a portion of the cue stick. In this manner, the portable bridge may be lifted from and repositioned on the surface of the table as desired. When the cue stick is lowered, the concave top of the front of the base disengages the portion of the cue stick such that the cue stick may be slidably removed from the opening in the upright arm.

These and other objects of the present invention will become apparent from a reading of the following specification, taken in conjunction with the enclosed drawings.

BRIEF DESCRIPTION OF THE DRAWINGS

FIG. 11 is a perspective view of an "O" ring disposed on the cue stick.

FIG. 12 is a perspective view of a pin through the cue stick.

FIGS. 13A–13C are a series of perspective views showing a foldable tongue on the cue stick.

DESCRIPTION OF PREFERRED EMBODIMENTS

Figure 1:
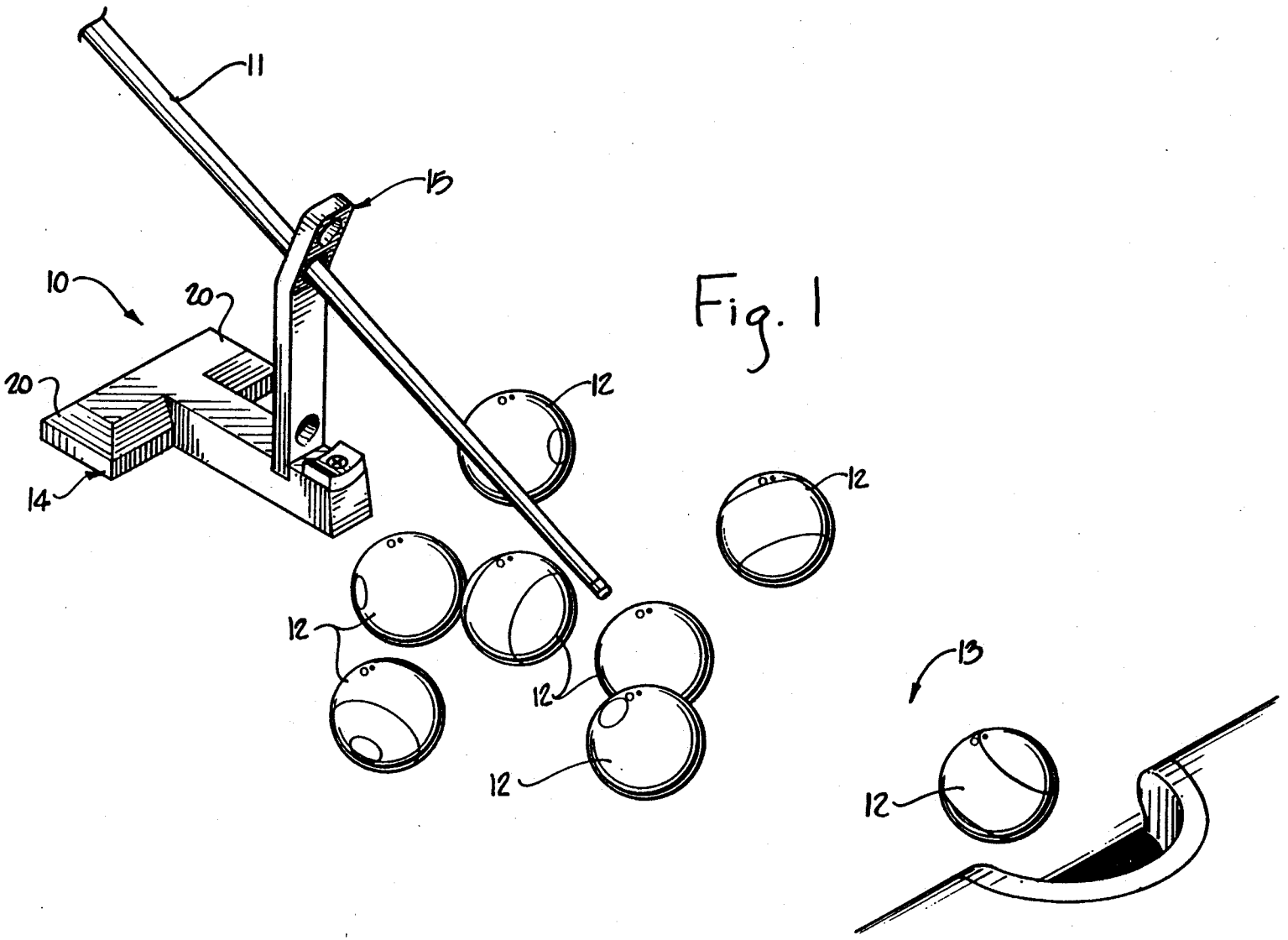
FIG. 1 is a perspective view showing the portable bridge of the present invention being used with a cue stick to strike a billiard ball on the playing table.

Referring to FIG. 1, the portable bridge 10 of the present invention is beneficially used by a player to enable the player to effectively use a cue stick 11 to strike a desired billiard ball 12 on the playing table 13. The player is able to have the cue stick 11 reach over obstructing balls 12 and direct the force of the cue stick 11 to the one selected ball 12. This is accomplished without the player using one hand to manipulate a pole attached to a bridge while trying to direct the cue stick 11 with another hand. The portable bridge 10 is easily raised and lowered to a desired location on the surface of the playing table 13 as will be described. The present invention is useful in the game of billiards, pool and related games.

Figure 4:
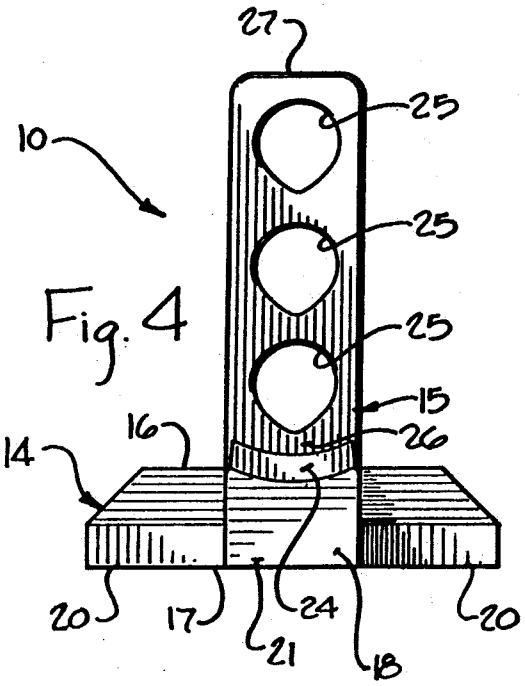
FIG. 4 is a back end plan view of the present invention.
Figure 2:
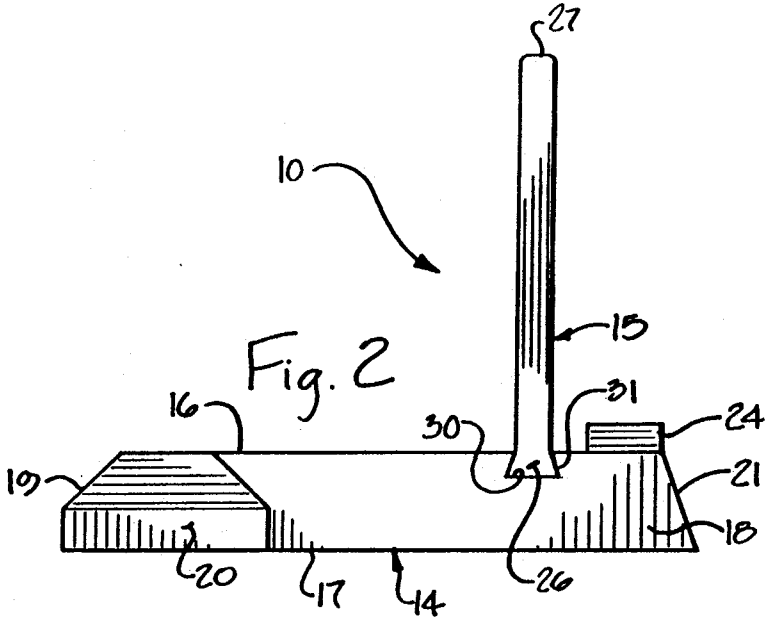
FIG. 2 is a side elevation view of the present invention showing the upright arm connected to the base.
Figure 3:
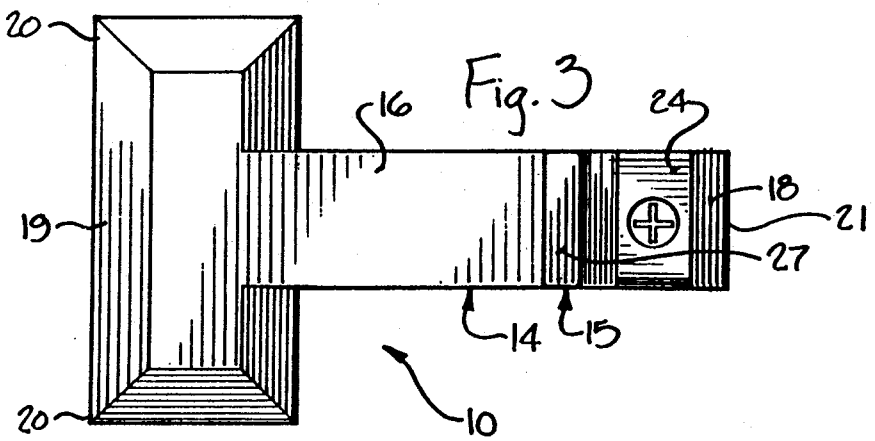
FIG. 3 is a top plan view of the present invention.

The portable bridge 10 includes a base 14 and an upright arm 15 (FIGS. 2-4). The base 14 has a top 16, a bottom 17, a front 18 and a back 19. Preferably, support means 20 extend outwardly from the back 19 of the base 14 to provide stability to the base 14 when the portable bride 10 is placed on the surface of the playing table 13. The support means 20 may be a pair of legs in the shape of a "T", a wishbone, or any other configuration desired to provide for stability. The bottom of the base 19 may be flat or smooth but preferably, has a coarse material attached thereto to reduce any movement of the portable bridge 10 on the surface of the playing table 13.

The front 18 of the base 14 has an end 21 and the end 21 has a top which is concave in shape. The concavity has a cross section sufficiently large to receive therein the cylindrical body of the cue stick 11 as will be described. Also, in a preferred embodiment, the concave top of the end 21 is formed of a rubber-like material to ensure engagement of the cue stick 11 as will be described. The rubber-like material may be an inset into the top of the end 21 or the rubber-like material may extend upwardly above the top of the end 21 in a lip-like form 24. The rubber-like material may be affixed to the top of the end 21 by a screw, a nail, adhesive or any means desired.

Figures 5, 6, 7, 8, 9:
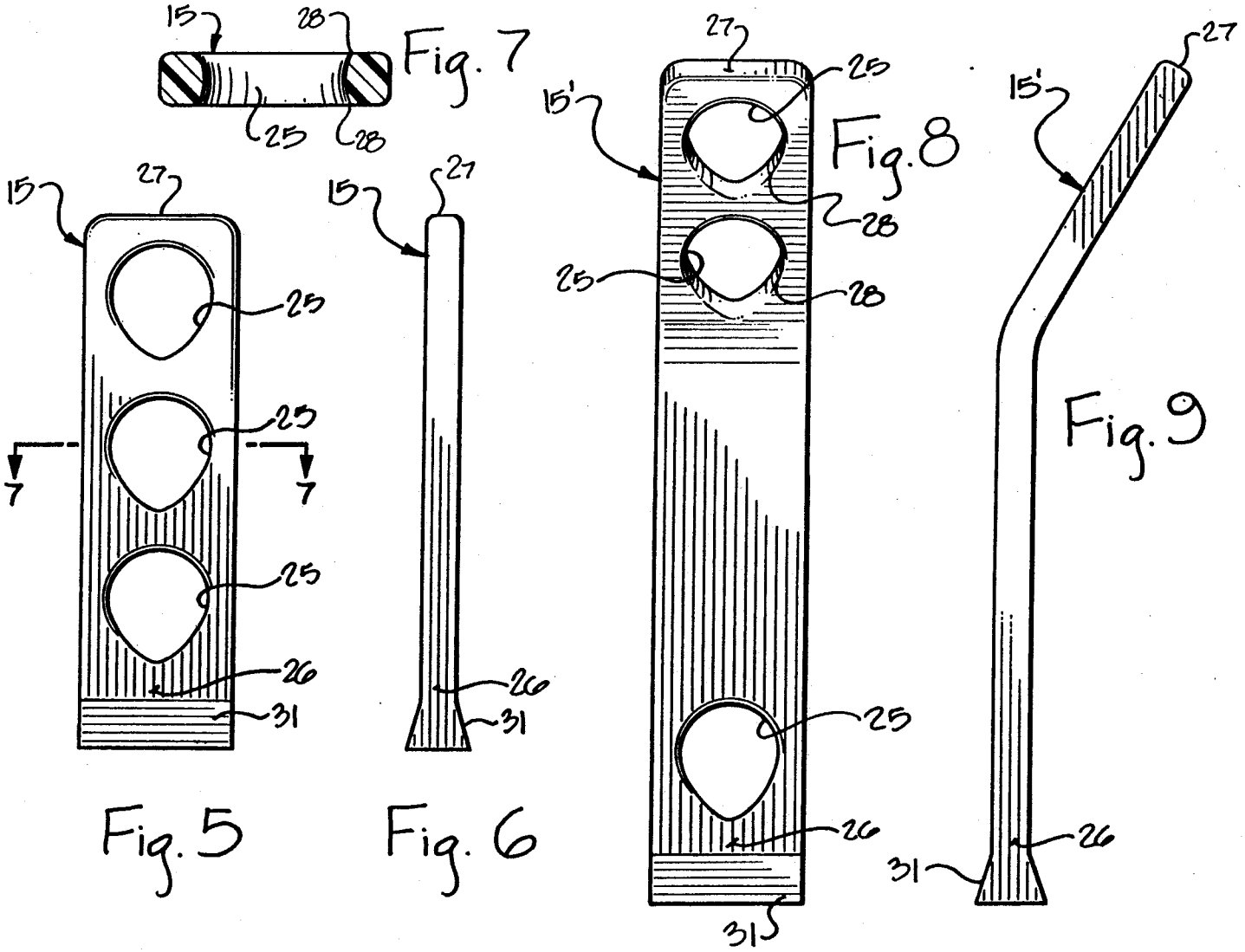
FIG. 5 is a front plan view of one embodiment of the upright arm.
FIG. 6 is a side plan view of the upright arm of FIG. 5.
FIG. 7 is a cross-sectional view taken across the lines 7—7 of FIG. 5.
FIG. 8 is a front plan view of another embodiment of the upright arm.
FIG. 9 is a side plan view of the upright arm of FIG. 7.

In a preferred embodiment, the upright arm 15 is a flat strip of rigid material (plastic, wood or metal) which has a plurality of openings 25 formed therein (FIGS. 5, 6). The openings 25 are spaced apart and are aligned linearly with respect to one another between the lower end 26 of the arm 25 and the upper end 27 of the arm 15. The openings 25 may be of any desired geometrical shape (e.g., round, oval, tear drop, square) but must have a cross section of sufficient dimension so that the cue stick 11 may be easily inserted in, and slidably removed from, the respective opening 25. The edges 28 of each opening 25 on both sides of the upright arm 15 are beveled so that the cross section of the opening 25 is slightly smaller across the center of the opening 25 than the cross section at the edges 28 (FIG. 7). This configuration facilitates insertion of the cue stick 11 into the opening 25, and permits the cue stick 11 to slide through the opening 25, especially when the cue stick 11 is directed angularly through the opening.

In a preferred embodiment one of the openings 25 is formed near the lower end 26 of the upright arm 15 wherein, when the upright arm 15 is connected to the base 14, the one of the openings 25 is adjacent to the base 14. It is preferred that the upright arm 15 be straight without any bends along the length thereof, however, in a desired use to enable the cue stick 11 to be aimed over a plurality of billiard balls 12, an upright arm 15' having a bend near the upper end 27 is provided (FIGS. 8, 9). The arm 15' having a bend therein is preferably of a greater length than the unbent arm 15 since this permits better access to a selected billiard ball 12 among a plurality of balls 12 in close proximity to one another. In the bent arm 15' embodiment, the openings are formed near the upper end 27 of the upright arm, between the bend and the end 27. In this manner, the player is provided greater leverage of the cue stick 11 to strike the ball 12 from an acute angle.

Means are provided to connect the upright arm 15, 15' to the base 14. The upright arm 15, 15', preferably, is connected substantially perpendicularly to the plane of the top 16 of the base 14. A preferred means of connecting the upright arm 15 is by a mortise and dovetail connection between upright arm 15 and the base 14. A mortise 30 is formed in the top 16 of the base 14, transversely thereto and near the front 18 of the base 14. A cooperating dovetail 31 is formed on the lower end 26 of the upright arm 15, 15'. The dovetail 31 is slidably received in the mortise 30 and the upright arm 15, 15' is securely connected to the base 14. The arm 15, 15' may be easily removed and a different arm may be inserted in the mortise 30. In this manner, for example, the player may use the straight arm 15 or the arm 15' having a bend therein as desired to enable the player to more easily manipulate the cue stick 11 to hit a selected ball 12. Other means of connecting the upright arm to the base may be used as are known to persons skilled in the art.

Figure 10B:
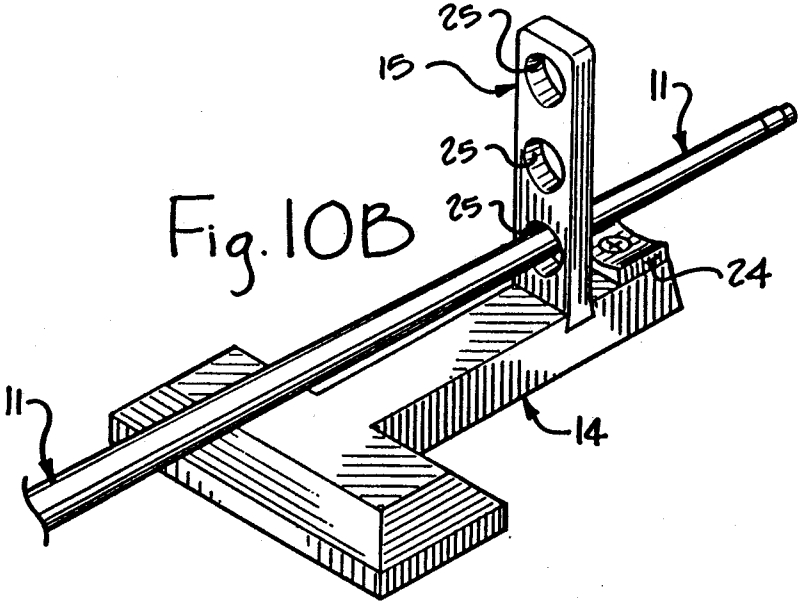
FIGS. 10A–10C are a series of perspective views showing the lifting of cue stick and the manner in which the portable bridge of the present invention is lifted thereby.
Figure 10A:
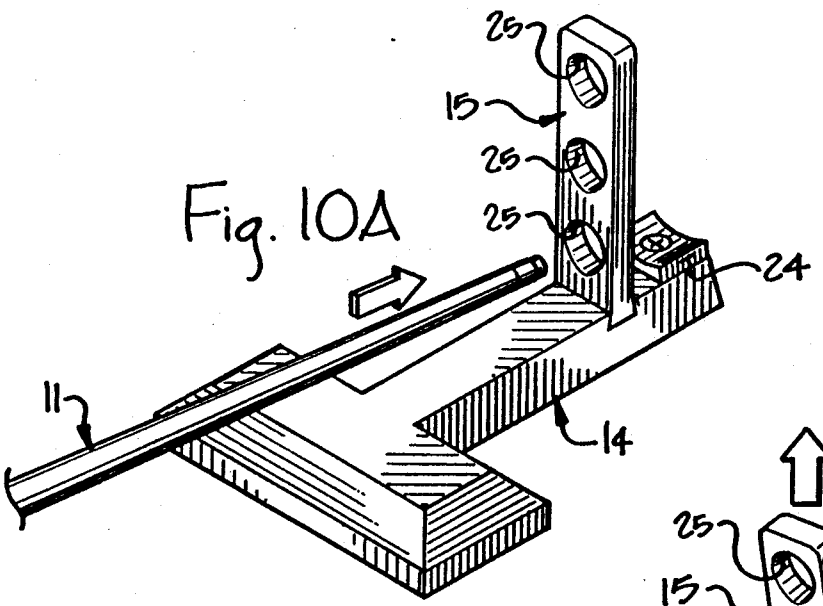
Figure 10C:
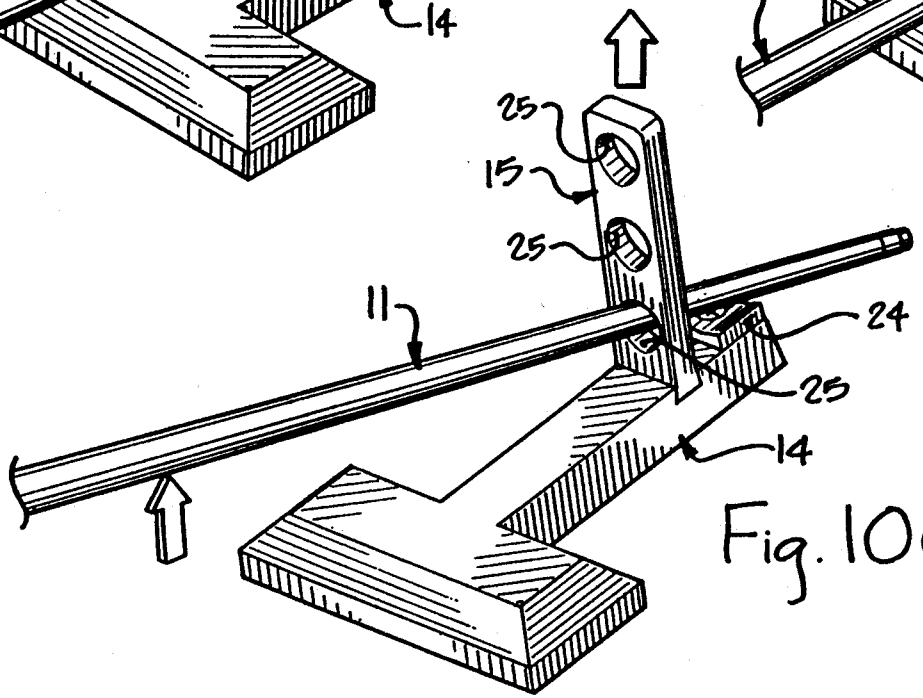

The portable bridge 10 is a compact, lightweight device which can be used in a manner similar to a standard bridge to assist the player in directing the cue stick 11 toward a ball 12 which would be unaccessible without the bridge. The portable bridge 10 is superior to the standard bridge in that it is very easily and rapidly lifted from the surface of the playing table 13 using only the cue stick which the player already has in the player's hand. This is accomplished by the player inserting the cue stick 11 into the opening 25 in the upright arm 15 which is adjacent to the base 14. The cue stick 11 is inserted sufficiently for the end of the cue stick 11 to extend beyond the front 18 of the base 14. The player, by lifting the end of the cue stick 11 upwardly, causes the concave top 22 of the front of the base 14 to engage a portion of the cue stick 11. The cue stick 11 thus, engages the upright arm 15 about the opening 25 in the upright arm 15 and the base 14 and the portable bridge 10 is lifted simultaneously with the cue stick 11. This lifting results from the back 19 of the base 14 dropping away from the cue stick 11 as the cue stick 11 and portable bridge 10 are lifted. The back 19 of the base 14 drops because the center of gravity of the portable bridge 10 is between the back 19 of the base 14 and the mortise 30 in the base 14 where the upright arm 15 is connected to the base 14. The lifting of the portable bridge is at a point toward the front of the base 14 with respect to the center of gravity (FIG. 10A-10C).

In this manner the portable bridge 10 may also be conveniently lowered to the playing table 13, adjusted to a desired position and rapidly lifted so that the portable bridge 10 is not struck by a ball 12 nor in anyway interfere with the playing of the game. The portable bridge 10 may easily be repositioned on the surface of the playing table 13 when desired. The player has both hands available to manipulate the cue stick 11 and is not encumbered by an additional pole connected to a conventional bridge.

In an alternate embodiment, a keeper means is manually adjusted on the cue stick 11 by the player after the cue stick 11 is inserted in the selected opening 25 in the upright arm 15 (FIGS. 11, 12, 13A-13C). The purpose of the keeper means is to prevent the cue stick 11 from being withdrawn from the opening 25. In this manner, when the cue stick 11 is lifted by the player, the upright arm 15 is supported against the keeper means and the portable bridge 10 is also lifted from the surface of the playing table 13. The portable bridge may be placed at another location on the playing table 13 or may be lifted from the playing surface so as to avoid any contact with a ball 12 on the surface of the table 13.

The keeper means may be an expandable, flexible ring 35 which may be manually slipped over the end of the cue stick 121 as desired. The flexible ring 35 must have a cross section sufficiently large so that the cue stick 11 with the flexible ring 35 thereon cannot be withdrawn through the opening 25 in the upright arm 15 (FIG. 11). The flexible ring 35 may be manually removed from the end of the cue stick 11 by the player when desired and, when so removed, permits withdrawal of the cue stick 11 from the opening 25 in the upright arm 15. An "O" type ring has been used satisfactorily as a keeper means.

Alternately, the keeper means may be a transverse hole 36 formed near the end of the cue stick 11 together with a pin 37. After the cue stick 11 has been inserted in the opening 25 in the upright arm 15, the pin 37 is manually inserted by the player, into the transverse hole 36 (FIG. 12). The pin 37 has a length greater than the cross section of the opening 25 and consequently, extends outwardly from the hole 36 in the cue stick 11 and prevents the cue stick 11 from being removed from the portable bridge 10. When desired, the pin 37 may be manually removed from the hole 36 by the player and the cue stick 11 may be withdrawn from the opening 25 in the upright arm 15.

Figure 14:
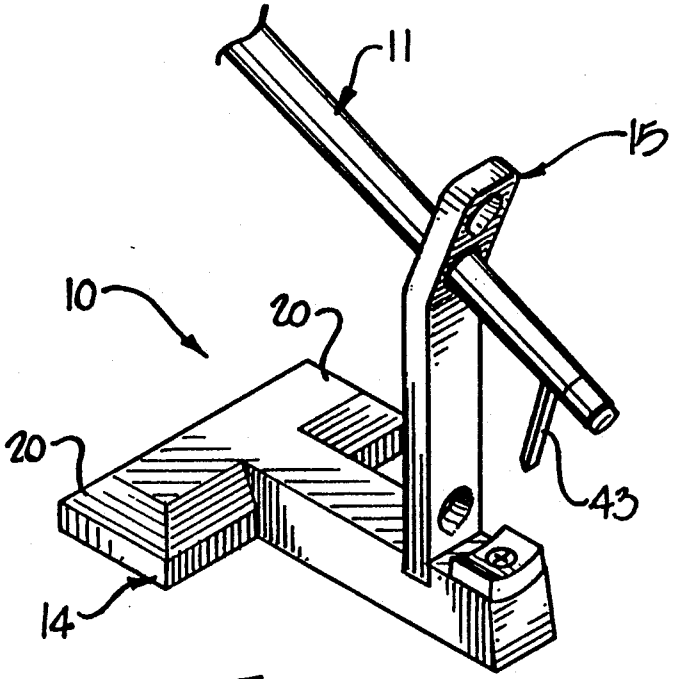
FIG. 14 is a perspective view showing the lifting of the portable bridge with the keeper means on the cue stick.

Still another alternative for the keeper means may be formed near the end of the cue stick 11. A longitudinal groove 40 may be formed in the cue stick 11 near the end thereof. Near the first end 41 of the groove 40 (the end nearer to the end of the cue stick 11) a pin 42 is disposed transversely of the groove 40. A tongue 43 is disposed in the groove 40 with the pin 42 being received in first end 44 of the tongue 43. The tongue 43 is thereby able to pivot about the pin 42. When thus pivoted, the second end 45 of the tongue opposite the first end of the tongue 44, may be moved between a first position within the groove 40 and a second upright position outside the groove 40. When in the upright position, the tongue 44 is supported by the walls of the first end 41 of the groove 40. If desired, the second end 46 of the groove 40 may be tapered so that the second end 45 of the tongue may be more easily grasped by the fingers of the player to facilitate pivoting of the tongue 44 (FIGS. 13A–13C). In this manner, the cue stick 11 may be inserted through the desired opening 25 in the upright arm 15 and the tongue 43 may be manually pivoted to the upright position. The tongue 43 has a length sufficient so that the cue stick 11 with the extended tongue 43 cannot be withdrawn through the opening 25 in the upright arm 15' (FIG. 14). Thus, the portable bridge 10 can be raised, lowered, or moved when the tongue 43 is extended from the cue stick 11. The player may manually pivot the tongue 43 into the groove 40 to permit removal of the cue stick 11 from the opening 25 in the upright arm 15. In this manner, a cue stick 11 is provided with a keeper means integral with the cue stick 11. The keeper means does not hinder or, in any manner, interfere with use of the cue stick 11 during playing of the game of billiards.

Accordingly, the present invention discloses a portable bridge 10 which can be moved to a desired location on the playing table by the use of the cue stick 11.

Figure 15:
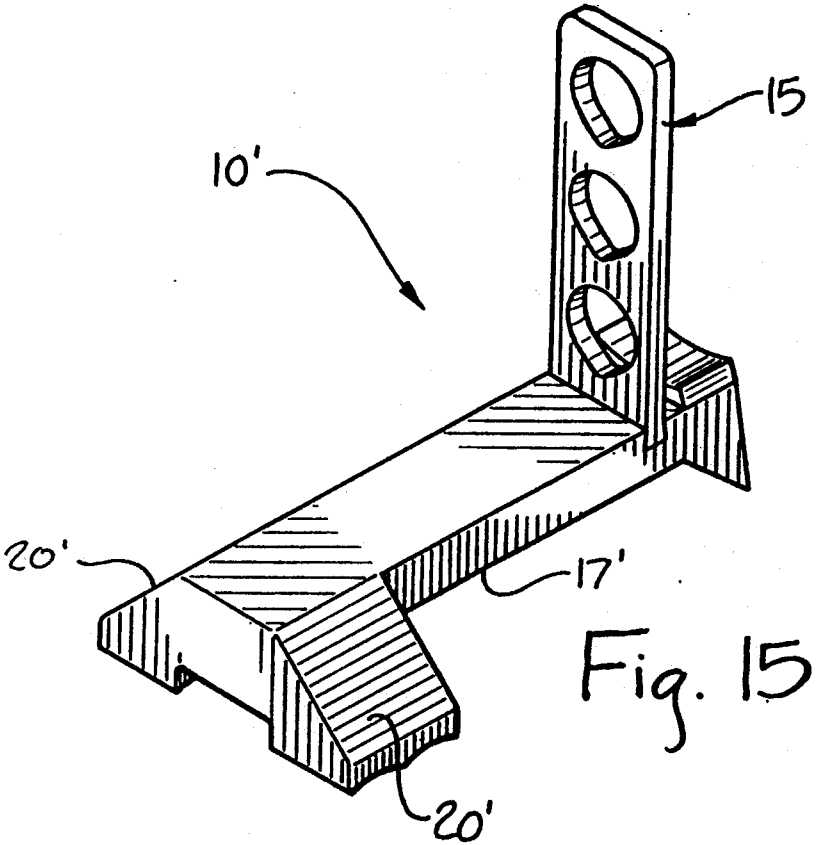
FIG. 15 is a perspective view of an alternate embodiment of the present invention.

An alternate embodiment of the portable bridge 10 is shown in FIG. 15. In this embodiment, the base 14' has an arched bottom 17' and support means 20'. The bottom of the base 17' may have at least one ridge formed thereon to reduce movement of the portable bridge 10' on the surface of the playing table. This embodiment effects a weight savings due to the arched configuration and the open space.

The portable bridge 10 can also be held by right or left handed players by holding the base 14 in the palm of the player's hand or between the thumb and fingers. This assists beginners of all ages, and permits the person just learning the game of billiards, to concentrate on movement of the cue stick 11 with the player's shooting arm. Use of the portable bridge 10 in this manner, eliminates the player's using one hand as a bridge.

Also, if desired, the player may remove the upright arm 15, 15' from the base 14 and hold the upright arm 15, 15' by the lower end 26 in the player's hand. By placing the cue stick 11 in the selected opening 25, the player may more effectively make different shots on the billiard table.

The upright arm 15, 15' may also be used as a teaching aid for all players. In this manner, the upright arm 15, 15' may take different shapes and lengths.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A portable bridge in combination with a cue stick for use in a game of billiards using billiard balls, the portable bridge being placed on, and removed from, the surface of a playing table, the portable bridge comprising:

an elongated base having a top, a bottom, a front end and a back end, the back end having support means extending therefrom to provide stability to the base when the portable bridge is placed on the surface of the playing table;

an upright arm, means connecting the upright arm substantially perpendicularly to the top of the base, said means being disposed near the front end;

said base having a concaved region on said top a predetermined distance from said front end, said predetermined distance extending between said front end and said means connecting;

a cue pool stick;

the upright arm having at least one opening formed therein, said at least one opening having a cross section, such that the cue stick may be inserted and longitudinally slidable therein to permit striking of a selected billiard ball with one end of the cue stick;

said at least one opening in the upright arm being adjacent to the base, such that one end of the cue stick is inserted through said at least one opening and the other end of the cue stick is lifted upwardly, the concave top of the front end of the base engages a portion of the cue stick, and the back end of the base drops away from the cue stick in a manner such that the portable bridge may be lifted from, and repositioned on, the surface of the table as desired and, when the other end of the cue stick is lowered, the concave region disengages the portion of the cue stick such that the cue stick may be slidably removed from said at least one opening.

2. The portable bridge of claim 1, wherein said means connecting is a mortise formed transversely on the top of the base, the upright arm having a lower end, said lower end having a cooperating dovetail formed thereon, said dovetail being slidably received in the mortise to connect the upright arm to the base and to permit lifting of the base when the cue stick, received in the opening in the upper arms, is lifted.

3. The portable bridge of claim 1, wherein the support means extending from the back end of the base are a pair of outwardly extending legs.

4. The portable bridge of claim 1, wherein the concave region is lined with a rubber-like material.

5. The portable bridge of claim 1, wherein the bottom of the base has at least one ridge formed therein such that movement of the portable bridge on the table is reduced.

6. A portable bridge in combination with a cue stick for use in a game of billiards using billiard balls, the portable bridge being placed on and removed from the surface of a playing table, the portable bridge comprising:

an elongated base having a top, a bottom, a front end and a back end, the back end having support means extending therefrom to provide stability to the base when the bridge is placed on the surface of the table, said front end having a top and a bottom, the bottom adapted to rest on the surface of the table, a pool cue stick;

an upright arm having a lower end and an upper end, the lower end being connected to the base, at least one opening formed in the arm, the at least one opening being disposed near the upper end of the arm, said opening having a cross section such that the cue stick may be slidably received therein to permit striking of a selected billiard ball with one end of the cue stick;

and keeper means mounted on the cue stick and being manually adjusted by a player to prevent the cue stick from being withdrawn from said opening, when the cue stick is lifted, said keeper means engages the upright arm and prevents removal of the cue stick from the opening such that lifting of the cue stick concurrently lifts the portable bridge from the surface of the table, said keeper means further being manually adjustable by a player and permit removal of the cue stick from the opening.

7. The portable bridge of claim 6, wherein the manually adjustable keeper means is an expandable, flexible ring which may be slipped on and may be removed from the cue stick as desired.

8. The portable bridge of claim 6, wherein the cue stick has a ball engaging end, a hole formed near said end, the manually adjustable keeper means being a pin means which maybe inserted in, and removed from, said hole.

9. The portable bridge of claim 6, wherein the cue stick has a first ball engaging end and a second handle end, a groove formed near said first end, the groove having a first end oriented toward the first ball engaging end and a second end oriented towards said second end of the cue stick, a pin extending through the groove near the first end of the groove and transversely thereof, a tongue disposed in the groove, the tongue having a first end and a second end, the pin being received in the first end of the tongue such that the tongue may be pivoted about the pin and when so pivoted, the second end of the tongue is moved from a first position within the groove to a second, upright position, outside the groove, such that the tongue is manually adjusted outside the groove by a player to engage the upright arm and prevent removal of the cue stick from the opening in the upright arm, and the tongue may be manually adjusted to be disposed within the groove by a player to permit disengagement of the tongue from the upright arm and permit removal of the cue stick from the opening in the upright arm.

10. The portable-bridge of claim 6, wherein the base has a mortise formed transversely thereof and on the top of the base near the front end thereof, the upright arm having a lower end, said lower end having a dovetail formed thereon, wherein the dovetail on the upright arm may be slidably received in the mortise in the base to connect the upright arm to the base and to permit lifting of the base, when the cue stick, received in the opening in the upper arm, is lifted.

11. The portable bridge of claim 6, wherein the support means extending from the back of the base is a pair of outwardly extending legs.

12. The portable bride of claim 6, wherein the bottom of the base has at least one ridge formed therein such that movement of the portable bridge on the table during use is reduced.

* * * * *